US008925520B2

(12) United States Patent
Pursifull et al.

(10) Patent No.: US 8,925,520 B2
(45) Date of Patent: Jan. 6, 2015

(54) INTAKE SYSTEM INCLUDING VACUUM ASPIRATOR

(75) Inventors: Ross Dykstra Pursifull, Dearborn, MI (US); Joseph Norman Ulrey, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 683 days.

(21) Appl. No.: 12/721,445

(22) Filed: Mar. 10, 2010

(65) Prior Publication Data

US 2011/0132311 A1 Jun. 9, 2011

(51) Int. Cl.

| | |
|---|---|
| ***F02D 9/08*** | (2006.01) |
| ***F02M 35/10*** | (2006.01) |
| ***F02D 31/00*** | (2006.01) |
| *F02B 37/00* | (2006.01) |

(52) U.S. Cl.

CPC ..... *F02M 35/10229* (2013.01); *F02D 9/08* (2013.01); *F02D 31/005* (2013.01); *F02B 37/00* (2013.01)

USPC ..... 123/339.23

(58) Field of Classification Search

CPC ... F02D 31/005; F02D 2009/024; F02D 9/08; F02M 35/10229

USPC ..... 123/559.2, 58.4, 336, 389, 437, 205.24, 123/184.39, 184.59, 188.1, 590, 184.56, 123/579, 188.14, 339.23; 137/112, 895, 137/908, 907; 417/176, 87; 60/39.15, 60/39.17, 39.52, 605.1

See application file for complete search history.

(56) References Cited

U.S. PATENT DOCUMENTS

| | | | | |
|---|---|---|---|---|
| 2,264,126 | A * | 11/1941 | Wydler | 123/559.2 |
| 2,721,629 | A | 5/1949 | Saussard | |
| 3,576,102 | A * | 4/1971 | West | 60/602 |
| 4,211,200 | A | 7/1980 | Rocchio et al. | |
| 4,281,686 | A * | 8/1981 | Gerlitz | 137/887 |
| 4,541,396 | A * | 9/1985 | Sato et al. | 123/518 |
| 4,625,703 | A * | 12/1986 | Otto et al. | 123/574 |
| 5,005,550 | A * | 4/1991 | Bugin et al. | 123/520 |
| 5,108,266 | A * | 4/1992 | Hewitt | 417/87 |
| 5,183,023 | A * | 2/1993 | Hanson | 123/520 |
| 6,951,199 | B2 | 10/2005 | Suzuki | |
| 7,174,883 | B2 | 2/2007 | Sonoda et al. | |
| 7,610,140 | B2 | 10/2009 | Hirooka | |
| 8,095,289 | B2 * | 1/2012 | Suzuki et al. | 701/70 |
| 8,109,259 | B2 * | 2/2012 | Ulrey et al. | 123/572 |

(Continued)

FOREIGN PATENT DOCUMENTS

| | | |
|---|---|---|
| DE | 4235794 C1 | 10/1993 |
| JP | 2005171925 | 6/2005 |

OTHER PUBLICATIONS

Vetrovec, John, "Fluid-Dynamic Supercharger", SAE Technical Paper Series 2008-01-0299; World Congress, Detroit Michigan, Apr. 14-17, 2008; 15 Pgs.

(Continued)

*Primary Examiner* — Lindsay Low
*Assistant Examiner* — Jacob Amick
(74) *Attorney, Agent, or Firm* — Julia Voutyras; Alleman Hall McCoy Russell & Tuttle LLP

(57) ABSTRACT

In some examples, reduced engine displacement reduces an engine's ability to provide brake booster vacuum. The present application relates to intake systems including a vacuum aspirator to generate vacuum.

6 Claims, 7 Drawing Sheets

(56) References Cited

U.S. PATENT DOCUMENTS

| | | | | |
|---|---|---|---|---|
| 2004/0182363 | A1 | 9/2004 | Suzuki | |
| 2005/0000769 | A1 | 1/2005 | Hawener et al. | |
| 2007/0295303 | A1* | 12/2007 | Hirooka | 123/339.23 |
| 2008/0121480 | A1 | 5/2008 | Kawamori et al. | |
| 2008/0264059 | A1 | 10/2008 | Hirooka | |
| 2008/0267789 | A1 | 10/2008 | Hirooka | |
| 2009/0317676 | A1* | 12/2009 | Andreas-Schott et al. | 429/24 |
| 2013/0167812 | A1* | 7/2013 | Kurihara et al. | 123/568.11 |

OTHER PUBLICATIONS

Pursifull, Ross, et al., "Discharging Stored EGR in Boosted Engine System"; U.S. Appl. No. 12/684,322, filed Jan. 8, 2010; FGT093092; 41 Pgs.

Partial Translation of Office Action of Chinese Application No. 201110060614.5, Issued Jul. 16, 2014, State Intellectual Property Office of PRC, 15 Pages.

* cited by examiner

INTAKE SYSTEM INCLUDING VACUUM ASPIRATOR

TECHNICAL FIELD

The present application relates to intake systems including a vacuum aspirator, for generating vacuum for use in a brake booster, for example.

BACKGROUND AND SUMMARY

Spark-ignited vehicles may use intake manifold vacuum to provide brake boost or power assist. Engine downsizing reduces the ability of these engines to provide brake booster vacuum. One existing solution is to add a vacuum pump, however the vacuum pump leads to parasitic fuel economy losses and increases overall vehicle cost.

In one approach described in U.S. Pat. No. 7,610,140, a vehicle ejector system has an ejector, a state change device that causes the ejector to function or stop functioning, and a control device that controls the state change device (Summary). "Furthermore . . . the control device may include a control prohibition portion that prohibits the control device from controlling the state change device so as to cause the ejector to function if water temperature of a cooling water of the internal combustion engine is less than or equal to a predetermined temperature" (col. 4 ll. 8-13).

The inventors herein recognize various issues with the above described approaches. During cold start, engine conditions (such as high manifold air pressure and low barometric pressure due to low temperature and/or high altitude) may limit the available vacuum for various engine systems, such as the brake booster. In downsized engines including a supercharger and/or turbocharger, boosting may further reduce the conditions under which brake vacuum is available. Further, as a range of cylinder pressures increase, so does a range of intake passage pressures increase. Intake systems including a single fixed geometry aspirator may function inefficiently or not at all at some pressures of the increased pressure range.

Consequently, methods, systems and devices for a vacuum aspirator included in an intake system are described. In a first example, an intake system includes an intake passage including a compressor, a throttle and an intake manifold, and an aspirator having a motive inlet communicating with the intake passage intermediate to the compressor and the throttle and the aspirator having an entraining inlet communicating with a vacuum reservoir via a first check valve, the reservoir different from the intake manifold, and the first check valve limiting flow from the intake passage to the vacuum reservoir.

In a second example, an intake system includes, a throttle, the throttle including a first inlet, a second inlet, and a plate, the plate located intermediate the first inlet and the outlet, the second inlet located intermediate to the throttle plate and the first inlet, the throttle positioned in an intake passage, and an aspirator having a motive inlet in communication with the intake passage, the aspirator having an outlet in communication with the second inlet of the throttle, the aspirator having an entraining inlet in communication with a vacuum reservoir via a first check valve, the first check valve limiting flow from the second inlet to the vacuum reservoir.

In a third example, an intake system having a plurality of vacuum boosters for a vacuum reservoir, includes a first aspirator having a first motive inlet, first entraining inlet, and first outlet, the first motive inlet in communication with an intake passage adjacent a high pressure outlet of a compressor, and a second aspirator having a second motive inlet, second entraining inlet, second outlet, and second check valve, where either the second outlet is in communication with the first entraining inlet or the second motive inlet is in communication with the first outlet, and the second entraining inlet in communication with a vacuum reservoir via the second check valve, the second check valve limiting from the second entraining inlet to the vacuum reservoir.

One advantage of the above examples is that excess compressor pressure and flow is used to generate vacuum. In this way, downsized engines including a turbocharger or supercharger may generate vacuum, even during cold start. Further, an example throttle including a first inlet and a second inlet may control flow through an example aspirator, as well as flow to an example manifold not from the aspirator, simplifying an intake system configuration. In examples including a plurality of aspirators one of the plurality may be configured for high flow and another may be configured for low flow, increasing an intake system's efficiency at generating vacuum over a wide pressure range.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

DETAILED DESCRIPTION

Figure 1:
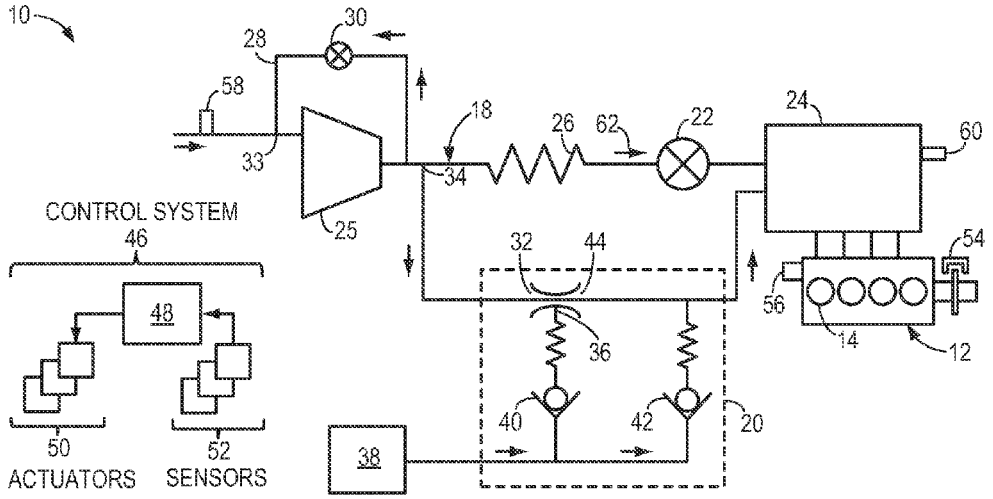
FIG. 1 shows a first example intake system for an engine.
Figure 8:
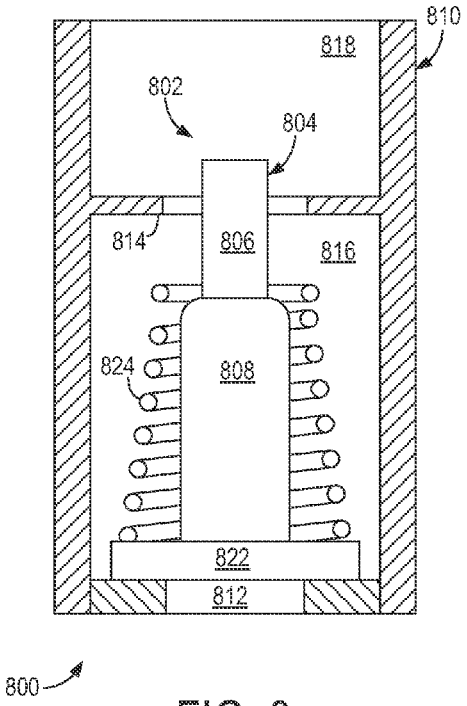
FIGS. 8 and 9 show a first example passive control valve.
Figure 9:
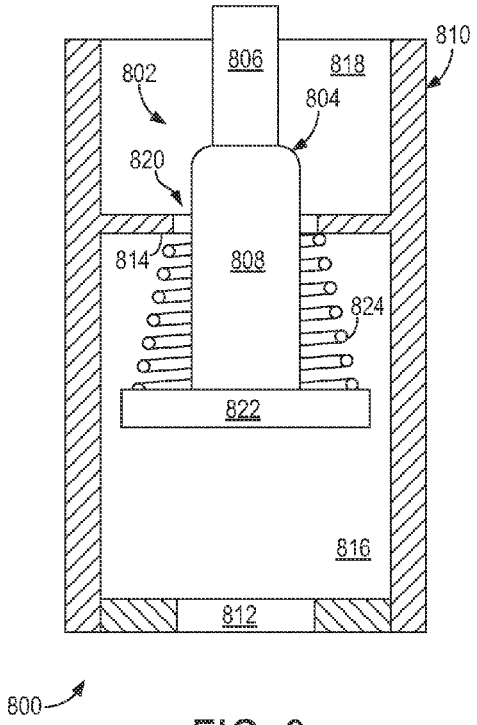

A first example intake system for an engine is described, with respect to FIG. 1, to introduce possible devices, arrangements and configurations of an intake system including an aspirator. Example aspirators are discussed in more detail with respect to FIGS. 2 and 3. Additional example intake systems are described with respect to FIGS. 4-7 and 10. FIGS. 8 and 9 show an example passive control valve included in some example intake systems. An example throttle included in example intake systems is discussed with respect to FIG. 10-12. Finally, multi-aspirator intake systems are described with respect to FIGS. 13-18. Integration of example intake systems with additional engine systems, such as fuel vapor purge and positive crankcase ventilation systems, is discussed with respect to FIGS. 19 and 20.

FIG. 1 shows a first example intake system 10 for an engine 12. In the present example, engine 12 is a spark-ignition engine of a vehicle, the engine including a plurality of cylinders 14, each cylinder including a piston. Combustion events in each cylinder 14 drive the pistons which in turn rotate crankshaft 16, as is well known to those of skill in the art. Further, engine 12 may include a plurality of engine valves, the valves coupled to the cylinders 14 and controlling the intake and exhaust of gases in the plurality of cylinders 14.

In the present example, intake system 10 includes an intake passage 18 and an aspirator 20. The intake passage 18 includes throttle 22 and an intake manifold 24. Manifold 24 provides air to engine 12. Air may enter intake passage 18 from an air intake system (AIS) including an air filter in communication with the vehicle's environment, for example. Further, throttle 22 is located intermediate to the intake manifold 24 and a compressor 25, the throttle 22 limiting the air entering intake manifold 24.

In the present example, intake passage 18 also includes compressor 25 and intercooler 26. Compressor 25 may be coupled to a turbine in an exhaust of engine 12. Further compressor 25 may be, at least in part, driven by an electric motor or crankshaft 16. Compressor 25 further includes a bypass passage 28 and compressor bypass valve (CBV) 30. CBV 30 may be used to control a level of air pressure in a portion of intake passage 18 between compressor 25 and engine 12, and in this way regulate a boost level, control for surge, etc.

As briefly described above, intake system 10 includes aspirator 20. Aspirator 20 may be an ejector, injector, eductor, venturi, jet pump, or similar passive device. Aspirator 20 has a motive flow entering inlet 32. Motive inlet 32 communicates with the intake passage 18 intermediate the compressor 25 and the throttle 22 at a high pressure outlet 34 of the compressor 25. In further examples, motive inlet 32 may communicate with additional high air pressure inputs. In the present example, and the aspirator having an entraining inlet 36 communicating with a vacuum reservoir 38 via a first check valve 40. High pressure air at the motive inlet 32 may be converted to flow energy in the aspirator 20, thereby creating a low pressure communicated to entraining inlet 36 and drawing air through entraining inlet 36. The first check valve 40 allows vacuum reservoir 38 to retain any of its vacuum should the pressures in 36 and 38 equalize. Further, aspirator 20 includes an outlet 44, in communication with the intake manifold. In the present example, the aspirator is the three port device including 32, 44, and 36. However, in further examples, check valves 40 and 42 are integrated into the device, and it will be appreciated that the device at 20 retains its name, "aspirator."

Further still, it should be appreciated that a flow path from 38 through 42 and continuing to 24 is designed carefully to not be flow restrictive. In this way vacuum may be recovered, should vacuum reservoir 38 ever be depleted.

Additionally, vacuum reservoir 38 is always different from the intake manifold 24. Vacuum reservoir 38 is a portion of, or device in, an engine system that utilizes vacuum. For example, vacuum reservoir 38 may be a vacuum cavity behind a diaphragm in a brake booster or a low pressure storage tank included in a fuel vapor purge system.

In the present example, intake system 10 further includes an optional auxiliary check valve 42. Auxiliary check valve 42 is in communication with the vacuum reservoir 38 and in communication with an outlet 44 of the aspirator. Further, the auxiliary check valve 42 limits flow from the outlet 11, to the vacuum reservoir 38. In this way, the auxiliary check valve 42 allows the vacuum reservoir 38 to retain its vacuum in the case where intake manifold 24 pressure rises above vacuum reservoir 38 pressure. Auxiliary check valve 42 limits communication from intake manifold 24 to vacuum reservoir 38, as well. Auxiliary check valve 42 is shown integrated into the aspirator 20, however in additional examples, auxiliary check valve 42 is separate from the aspirator 20.

Additionally, intake system 10 may include a control system 46 including a controller 48, sensors 50 and actuators 52. Example sensors include engine speed sensor 54, engine coolant temperature sensor 56, a mass air flow sensor 58, and manifold air pressure sensor 60. Example actuators include engine valves, CBV 30, and throttle 22. Controller 48 may further include a physical memory with instructions, programs and/or code for operating the engine.

A plurality of arrows 62 illustrate example flowpaths by which intake air may pass through the intake system 10. Air flows into intake passage 18 and reaches a low pressure compressor inlet 33. Aspirator 20 communicates with intake passage 18 at 34, and a passage at 34 may include profile or diameter which determines a rate at which air flows into the motive inlet 32. In this way, a pressure difference between the compressor outlet 34 and the intake manifold 24 may be used to generate vacuum in the vacuum reservoir. Consequently, in downsized engines including a turbocharger or supercharger even during cold start, vacuum may be generated, regardless of an intake manifold pressure and without inclusion of a vacuum pump. For example, even when little manifold vacuum is present, sufficient vacuum may still be generated by harvesting the pressure difference compressor pressure and intake manifold pressure.

Figure 2:
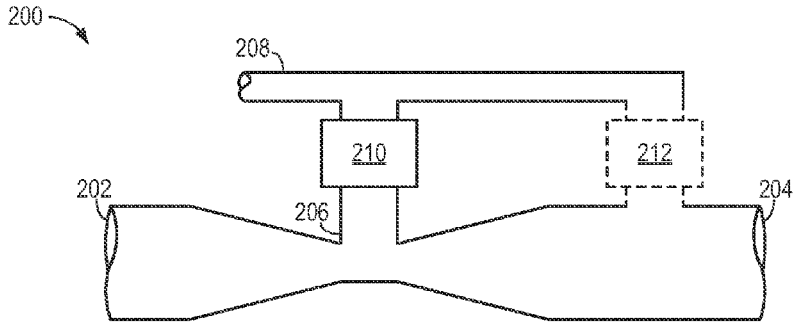
FIG. 2 shows a first example aspirator.

Turning now to FIG. 2, a first example aspirator 200 is shown. Aspirator 200 is a venturi-type in the present example. In the present example, motive air is received at inlet 202. Motive inlet 202 receives high pressure air, for example from a compressor outlet. Gas flowing out of aspirator 200 leaves via outlet 204 at a lower pressure, and continues, for example, to an intake manifold and/or a low pressure compressor inlet. A profile (e.g., a cross-sectional area) of the aspirator 200 tapers from the motive inlet 202 to an entraining inlet 206, and then expands from the entraining inlet 206 to the outlet 204. As a result, a high velocity, and a low pressure may be induced at the entraining inlet 206, thus drawing air through the entraining inlet 206 from an example vacuum reservoir in communication with the aspirator, (e.g., via passage 208). A first check valve 210 limits reverse flow from the entraining opening to the vacuum reservoir. In this way, gases are removed from the vacuum reservoir but may be prevented from entering via the entraining inlet 206.

Further, aspirator 200 may include an auxiliary check valve 212 (shown in dashed lines to indicate its optional inclusion). In the present example, auxiliary check valve 212 limits flow from the outlet 204 to the example vacuum reservoir, the reservoir in communication with check valve 212 via passage 208. In this way, when the outlet 204 has a low pressure, for example when it's in communication with an example intake manifold, auxiliary check valve 212 acts to increase vacuum in the example vacuum reservoir by facilitating the flow of gas to the outlet 204.

Further, the venturi-type aspirator 200, may produce vacuum at 206 from flow going from 202 to 204 and from flow going from 204 to 206. In some examples, aspirator symmetry allows for vacuum production in either flow direction. One advantage is that when the venturi is connected between an example intake manifold and an example intake passage a pressure difference between the intake manifold and intake passage pulls in air or vents air out, regardless of direction and produces vacuum in an example vacuum reservoir.

Figure 3:
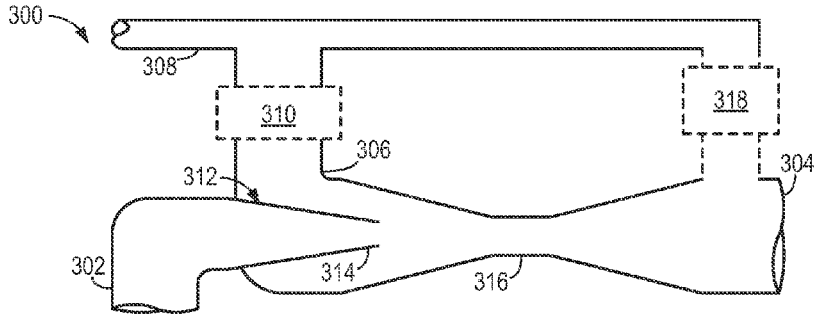
FIG. 3 shows a second example aspirator.

Turning now to FIG. 3, a second example aspirator 300 is shown. Aspirator 300 is an ejector-type passive valve in the present example. In the present example, motive air flow is received at an inlet 302. Motive inlet 302 receives high pressure air from, for example, a compressor outlet. Gas flowing out of aspirator 300 leaves via outlet 304 at a low pressure, and continues, for example, to an intake manifold and/or a low pressure compressor inlet.

Aspirator 300 includes a motive nozzle, 312. A profile (e.g., a cross-sectional area) of the motive inlet narrows along the length of the nozzle 312, to a tip 314 of motive nozzle. As a result, a high velocity, and a low pressure may be induced at the nozzle tip 314, thus drawing air through an entraining inlet 306 from an example vacuum reservoir in communication with the aspirator, (e.g., via passage 308). Further, the aspirator may include a profile that converges from the nozzle tip 314 and entraining inlet 306 to a throat 316 and then diverges from throat 316 to the outlet 304. In one example, the throat 316 has a low pressure, and high velocity gas, further drawing air through the entraining inlet 306.

In the present example, aspirator 300 includes a first check valve 310 and auxiliary check valve 318. However, both first check valve 310 and auxiliary check valve 318 are shown in dashed lines in FIG. 3 to indicate their optional nature. In further examples of aspirator 300, motive flow may come in through the inlet at 306 and entrained flow may come in passage 302. Thus in the present example, the motive flow can either be on the inner core flow as shown explained above, or the motive flow can on the outer annular flow as is known to those of skill in the art.

Figure 4:
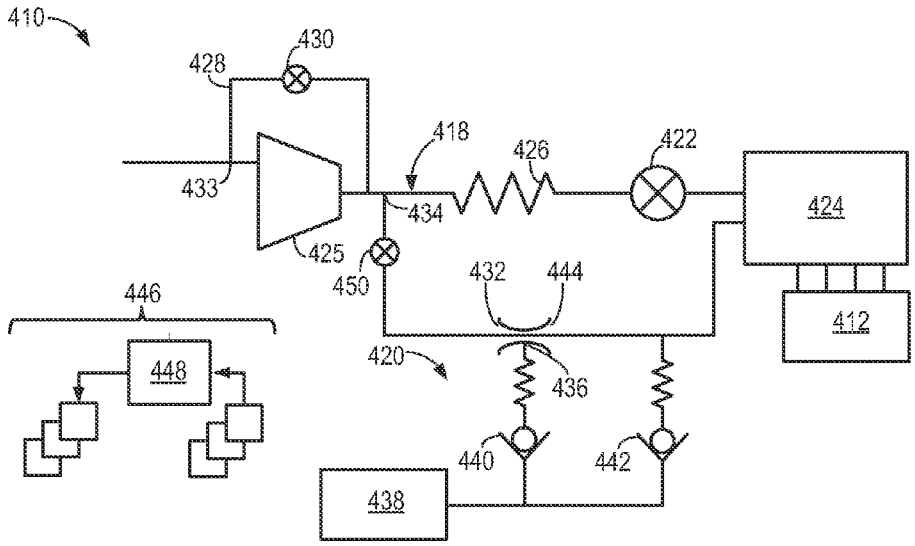
FIGS. 4-7 show further example intake systems for an engine.

Turning now to FIG. 4, a second example intake system 410 for an example engine 412 is shown. Intake system 410, includes example intake passage 418, further including example compressor 425, intercooler 426, throttle 422, and intake manifold 424. Compressor 425 includes a high pressure outlet 434, a bypass 428 and CBV 430, and a low pressure inlet 433, as described above with reference to FIG. 1. Additionally intake system 410 includes example control system 446.

Further, intake system 410 includes aspirator 420, which itself includes example motive inlet 432, entraining inlet 436, outlet 444, first check valve 440 and auxiliary check valve 442. As described above, aspirator motive inlet 432 is in communication with intake passage 418 at compressor outlet 434. Entraining inlet 436 is coupled to an example vacuum reservoir 438. Further, outlet 444 is in communication with manifold 424, as well as auxiliary check valve 442.

In the present example a solenoid valve 450 is included in intake system 410. Solenoid valve may be a continuously variable valve, such as a butterfly valve. Solenoid valve 450 is coupled intermediate to the intake passage 418 and the motive inlet 432 of the aspirator 420. Solenoid valve 450 may open and close in response to signals from controller 448 included in control system 446. In a first mode, solenoid valve 450 may allow communication between intake passage 418 and aspirator 420 and in a second mode, solenoid valve may close and limit communication between intake passage 418 and aspirator 420. In this way, solenoid valve 450 may ensure that a minimum vacuum threshold is maintained in manifold 424. Further, the solenoid valve can be closed (partially or wholly) when the airflow is higher than desired and the intake manifold is already producing target vacuum levels. Solenoid valve 450 is one example of a valve that can control flow through aspirator 420 and also ensure that a minimum vacuum threshold is maintained in manifold 424 (further examples are discussed below).

Figure 5:
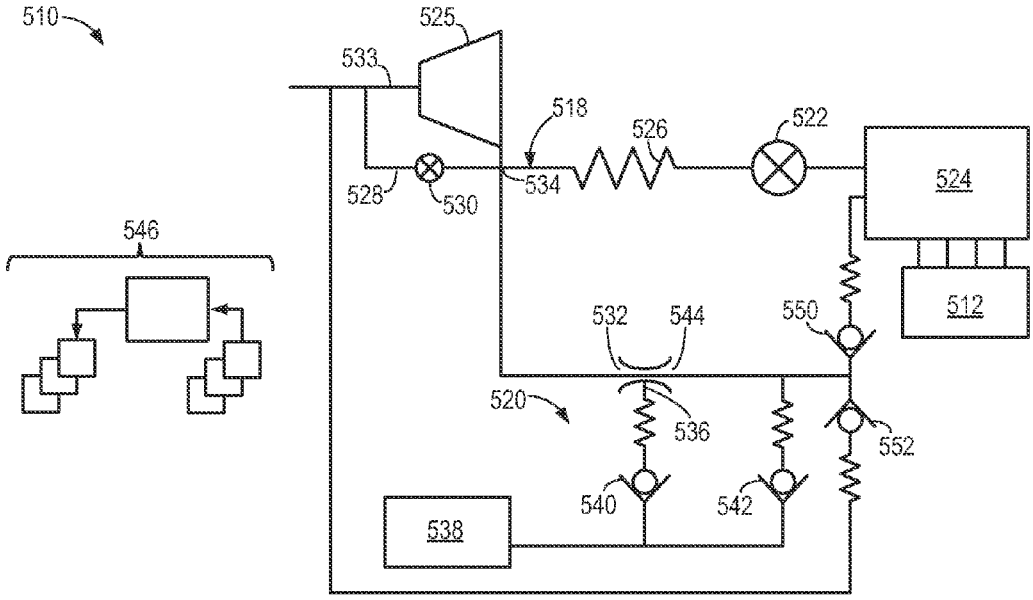

Turning now to FIG. 5, a third example intake system 510 for an example engine 512 is shown. Intake system 510 includes example intake passage 518, further including example compressor 525, intercooler 526, throttle 522, and intake manifold 524. Compressor 525 includes a high pressure outlet 534, a bypass 528 and CBV 530, and a low pressure inlet 533, as described above with reference to FIG. 1. Additionally intake system 510 includes example control system 546.

Further, intake system 510 includes aspirator 520, which itself includes example motive inlet 532, entraining inlet 536, outlet 544, first check valve 540 and auxiliary check valve 542. As described above, aspirator motive inlet 532 is in communication with intake passage 518 adjacent compressor outlet 534. Entraining inlet 536 is coupled to an example vacuum reservoir 538. Further, outlet 544 is in communication with auxiliary check valve 542.

Additionally, in the present example, intake system 510 further includes a manifold check valve 550 intermediate the outlet 544 of the aspirator 520 and the manifold 524. The manifold check valve 550 limits flow from the intake manifold 524 to the outlet 544. Further, outlet 544 of the aspirator 520 is in communication with the intake passage of the compressor, adjacent low pressure compressor inlet 533. Because low pressure compressor inlet 533 is the point at which compressor 525 receives air before that air travels further on in intake system 510, inlet 533 is said to be upstream of compressor 525. Intake system 510 further includes an intake check valve 552 intermediate to the outlet 544 of the aspirator 520 and the intake passage 518. The intake check valve 552 limits flow from the intake passage to the outlet. In additional examples, intake system 510 may include only one of the manifold check valve 550 and intake check valve 552.

In the present example, the resistance of the check valves 550 and 552 may maintain a minimum vacuum threshold in manifold 524. Further, the check valves may ensure that the outlet 544 is in communication with one of the intake passage 518 upstream of the compressor 525 or the manifold 524, depending on which of these two locations has a lower pressure. The aspirator inlet 532 may be the highest pressure point in the system. In further examples, the placement of check valves 552 and 550 passively control pressure so that the aspirator outlet is the lowest pressure point in intake system 510. Thus the aspirator may enjoy the benefit of using the greatest available air pressure difference to produce vacuum.

Figure 6:
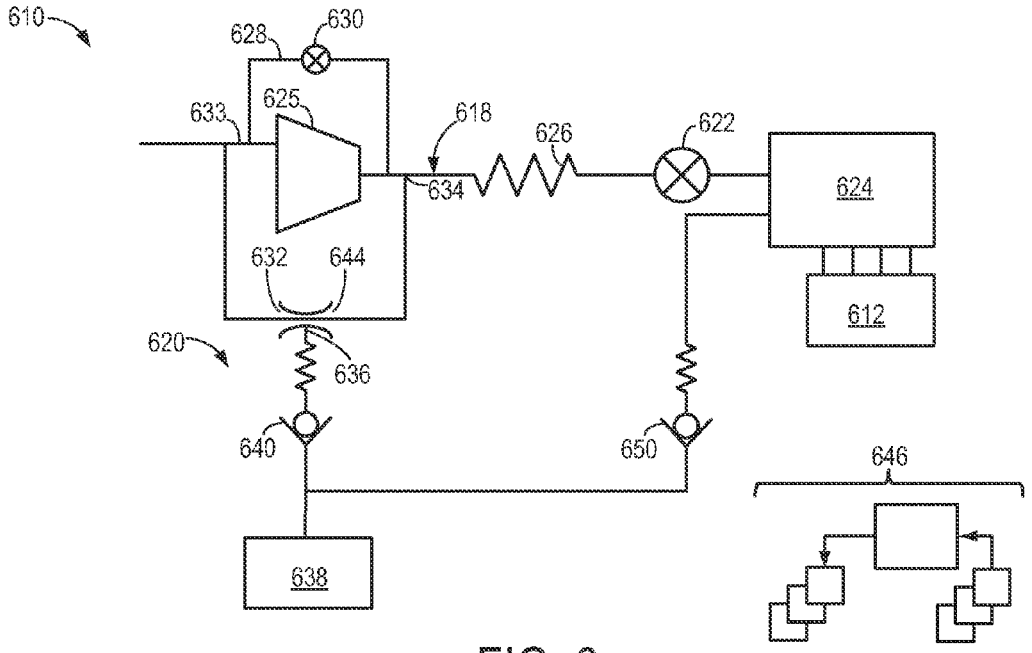

Turning now to FIG. 6, a fourth example intake system 610 for an example engine 612 is shown. Intake system 610, includes example intake passage 618, further including example compressor 625, intercooler 626, throttle 622, and intake manifold 624. Compressor 625 includes a high pressure outlet 634, a bypass 628 and CBV 630, and a low pressure inlet 633, as described above with reference to FIG. 1. Additionally intake system 610 includes example control system 646.

Further, intake system 610 includes aspirator 620, which itself includes example motive inlet 632, entraining inlet 636, outlet 644, and first check valve 640. Entraining inlet 636 is coupled to an example vacuum reservoir 638. As described above, aspirator motive inlet 632 is in communication with intake passage 618 at compressor outlet 634. Further, outlet 644 is in communication with a low pressure compressor inlet 633, upstream of compressor 625 in intake passage 618. An auxiliary check valve limiting communication between outlet 644 and vacuum reservoir 638 is not shown included in intake system 610. However, it will be understood that intake system 610 may further include such an example auxiliary check valve.

Additionally, intake system 610 includes example manifold check valve 650 intermediate vacuum reservoir 638 and the manifold 624. Manifold check valve 650 limits flow from the intake manifold 624 to the vacuum reservoir 638 in the present example. The resistance of manifold check valve 650 may maintain a minimum vacuum threshold in manifold 624 and/or in vacuum reservoir 638. Further, by including manifold check valve 650 independent of aspirator 620 vacuum in vacuum reservoir 638 is maintained regardless of a pressure at either the compressor inlet 633 or outlet 634.

Figure 7:
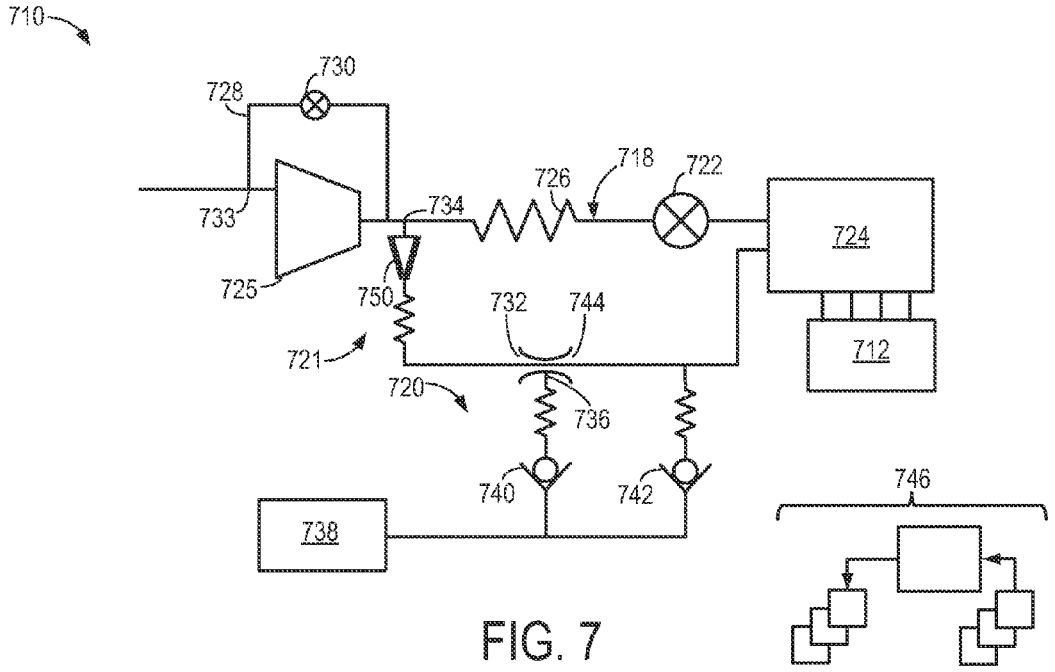

Turning now to FIG. 7, a fifth example intake system 710 for an example engine 712 is shown. Intake system 710, includes example intake passage 718, further including example compressor 725, intercooler 726, throttle 722, and intake manifold 724. Compressor 725 includes a high pressure outlet 734, a bypass 728 and CBV 730, and a low pressure inlet 733, as described above with reference to FIG. 1. Additionally intake system 710 includes example control system 746.

Further, intake system 710 includes aspirator 720, which itself includes example motive inlet 732, entraining inlet 736, outlet 744, first check valve 740 and auxiliary check valve 742. As described above, aspirator motive inlet 732 is in communication with intake passage 718 at compressor outlet 734. Entraining inlet 736 is in communication with an example vacuum reservoir 738. Further, outlet 744 is in communication with manifold 724, as well as auxiliary check valve 742.

In the present example a passive control valve 750 is included in intake system 710. Passive control valve 750 is intermediate the intake passage 718 and the motive inlet 732 of the aspirator 720. Passive control 750 may be located anywhere along a flow conduit 721 between 734 and 724. At high levels of intake manifold 724 vacuum, passive valve 750 can restrict or shut. In this case, the vacuum needed for vacuum reservoir 738 is provided mainly from intake manifold 724. At low levels of intake manifold 724 vacuum, passive valve 750 can open resulting in copious flow through the ejector thus providing the vacuum required at vacuum reservoir 738.

Also, passive control valve 750 may increase or limit communication between intake passage 718 and aspirator 720 in response to a pressure difference between the intake passage 718 and aspirator 720. Further, one example of passive control valve 750 (discussed below with respect to FIGS. 8 and 9) may include a first operating mode having a first flow rate, and a second operating mode having a second flow rate, the first flow rate greater than the second.

An example device having a similar flow characteristic to 750 is a Positive Crankcase Ventilation valve (PCV valve). When vacuum is high, valve 750 restricts flow. When vacuum is low, valve 750 un-restricts flow. Further, valve 750 has a third mode; when a threshold pressure is present at valve 750, it may shut. In this way valve 750 may vary flow restriction based on pressure differential. In a PCV valve, this is called the backfire mode. In additional configurations where valve 750 lies between 724 and 744, valve 750 may take on the function of valve 742, making valve 742 optional.

In additional examples, passive control valve 750 is positioned intermediate to the aspirator 720 and at least one of intake manifold 724 or low pressure compressor input 733. Further, passive control valve 750 may ensure that a minimum vacuum threshold is maintained in manifold 724, and may have analogous to a two port pressure regulator. Passive control valve 750 is one example of a valve that can control flow through aspirator 720 and also ensure that a minimum vacuum threshold is maintained in manifold 724.

FIG. 8 shows an example passive control valve 800 in a first position, the first position being a closed position. The closed position shown in FIG. 8 is one example of a rest position. The rest position is one example of a backfire position where intake manifold pressure exceeds crankcase pressure and is the maximally flow restrictive position. Valve 800 includes a valve body 802 having a stem 804. Stem 804 has a first profile 806 and a second profile 808. Further, valve 800 includes a valve housing 810 that defines both a main opening 812, a stem opening 814, a first chamber 816, and a second chamber 818, the housing 810 sustainably containing valve body 802. Valve housing further defines a second chamber 818; valve stem 804 penetrates through stem opening 814 into the second chamber 818. Further, a valve head 822 included in valve body 802 is coupled to a spring 824.

In the present closed position a valve head 822 (included in valve body 802 and coupled to the stem 804) seals main opening 812 from first chamber 816. Further, pressure in first chamber 816 may be greater than at opening 812. In additional examples, spring 824 extends from valve head 816 to valve housing 810 adjacent stem opening 814, and increases the force on valve head 822 against housing 810.

FIG. 9 shows the example passive control valve 800 in a second, open position. Spring 824 is during a compressed spring mode. FIG. 9 is illustrative and a spacing between coils of spring 824 may be less than a spacing shown in FIG. 8. A force on valve head 822 from the pressure communicated via main opening 812 overcomes a force exerted on valve body 802 from spring 824 and second chamber 818. An annular passage 820 between first chamber 816 and second chamber 818 is defined by one of the first profile 806 or the second profile 808 and stem opening 812. Annular passage 820 includes a cross-sectional area that partially determines a rate of flow through the stem opening 812 and thus through valve 800.

The profile of the stem 804 defining annular passage 820 may change in response to the displacement of the valve body. In the present example, second profile 808 and stem opening 812 collectively define the annular passage 820 (e.g., the valve 800 controls for a second flow rate in a second operating mode). In the additional examples, first profile 806 and stem opening 812 collectively define the annular passage 820 (e.g., the valve 800 controls for a first flow rate in a first operating mode). As a pressure on valve head 814 increases, the force on spring 824 increases, changing the displacement of the valve body 802. In this way a pressure difference between a second chamber and the first chamber may control flow through the valve 800. Additional examples of valve 800 include additional profiles (e.g., a cone profile, or profile including a parabolic-shaped edge), to further control an example annular passage cross-sectional area in response to displacement of the valve body 802. As illustrated, valve 800 depends on a gravitational orientation. Further examples do not have this orientation dependence.

Figure 10:
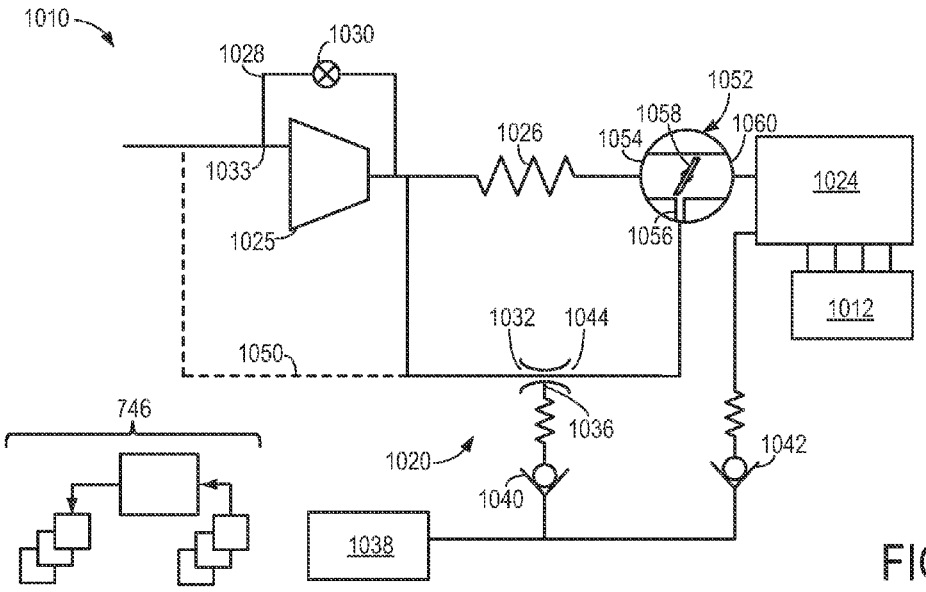
FIG. 10 shows a sixth example intake system for an engine.

Turning now to FIG. 10, a sixth example intake system 1010 for an example engine 1012 is shown. Intake system 1010 includes example intake passage 1018, further including example compressor 1025, intercooler 1026, and intake manifold 1024. Optional compressor 1025 includes a high pressure outlet 1034, a bypass 1028 and CBV 1030, and a low pressure inlet 1033, as described above with reference to FIG. 1. Additionally intake system 1010 includes example control system 1046.

Further, intake system 1010 includes aspirator 1020, which itself includes example motive inlet 1032, entraining inlet 1036, outlet 1044, and first check valve 1040. As described above, aspirator motive inlet 1032 is in communication with intake passage 1018 at compressor outlet 1034. However, in further examples of intake system 1010, motive inlet 1032 may be in communication with intake passage 1018 at additional locations, such as at compressor inlet 1033 (as indicated by dashed line 1050). Entraining inlet 1036 is coupled to an example vacuum reservoir 1038. Further, outlet 1044 is in communication with manifold 1024.

Further, intake system 1010 includes a throttle 1052 positioned in intake passage 1018, the throttle 1052 including a first inlet 1054, a second inlet 1056, and a plate 1058. Throttle 1052 is one example of a ported throttle. The plate 1058 is located intermediate the first inlet 1054 and an outlet 1060, the second inlet 1056 located intermediate the throttle plate 1058 and the first inlet 1054. The outlet 1044 of the aspirator 1020 is in communication with the second inlet 1056 of the throttle 1052. When a throttle plate 1058 is rotated to a first angle, second inlet 1056 may be in fluid communication with outlet 1060, while the throttle plate 1058 limits communication between the first inlet 1054 and the outlet 1060. In this way, throttle 1052 may control flow through aspirator 1020. Intake system 1010 includes example ported throttle 1052 so that flow through an example aspirator as well as flow to an example manifold not from the aspirator may be controlled by a single valve. In this way intake system 1010 has a simplifying configuration. Further, throttle 1052 is discussed in more detail below with respect to FIGS. 10 and 11

Further, intake system 1010 includes a second check valve 1042 (an example manifold check valve) coupled intermediate the vacuum reservoir 1038 and the manifold 1024. The second check valve 1042 limits flow from the intake manifold 1024 to the vacuum reservoir 1038.

Figure 11:
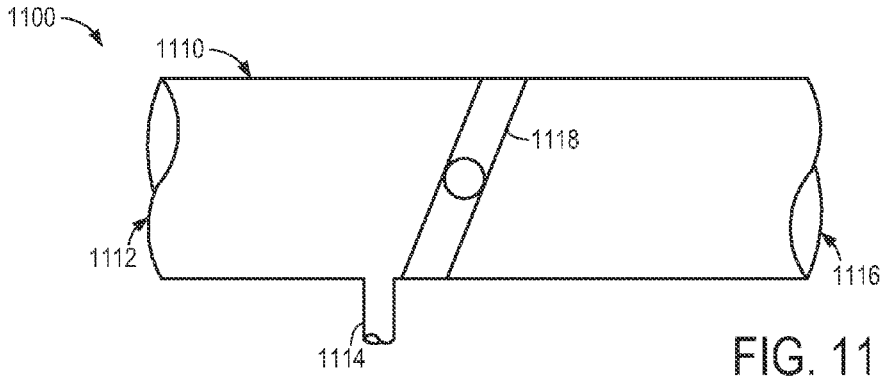
FIGS. 11 and 12 show a first example throttle included in an intake system, and in communication with an aspirator.
Figure 12:
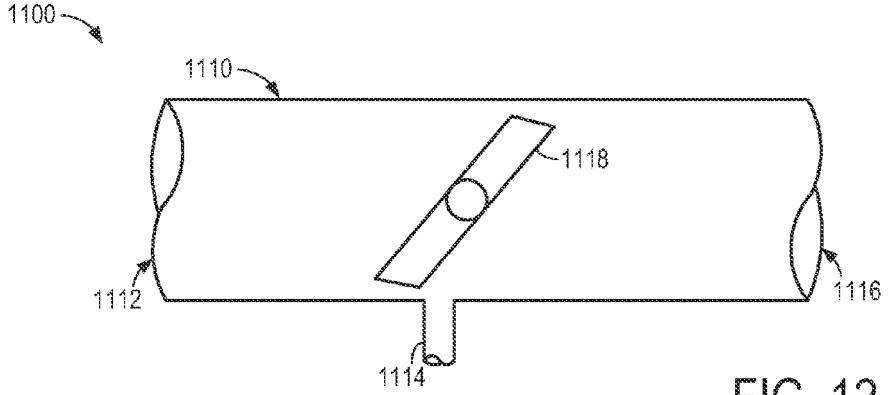

Turing now to FIGS. 11 and 12, an example ported throttle 1110 positioned in an example intake passage 1100, the throttle 1110 including a first inlet 1112, a second inlet 1114, an outlet 1116, and a plate 1118. As described above with respect to FIG. 10, the plate 1118 is located intermediate the first inlet 1112 and outlet 1116, the second inlet 1114 located intermediate the throttle plate 1118 and the first inlet 1112. An example aspirator outlet is in communication with the second inlet 1114.

FIG. 11 shows throttle plate 1118 in a first, closed position. In the present example, throttle 1110 is a butterfly-type valve that may be rotated to control fluid communication of at least one of the first inlet 1112 and the second inlet 1114 with the outlet 1116. During a warm idle air flow rate, the throttle is closed, as illustrated. In further examples the throttle plate 1118 may be near closed. In a closed or near closed position, the throttle plate 1118 limits communication between the second inlet 1114 and the outlet 1116. In this way, throttle 1110 may reduce air flow through an example aspirator. Further, in the present example an example intake manifold may supply vacuum.

FIG. 12 shows throttle plate 1118 in a second, substantially open position. When the throttle is substantially open (for example, during a cold start emission reduction (CSER) event) the throttle enables fluid communication between the second inlet 1114 and the outlet 1116. In this way the throttle opens enough to expose second inlet 1114 to an example intake manifold vacuum, thus causing air flow through an example aspirator coupled to second inlet 1114.

Figure 13:
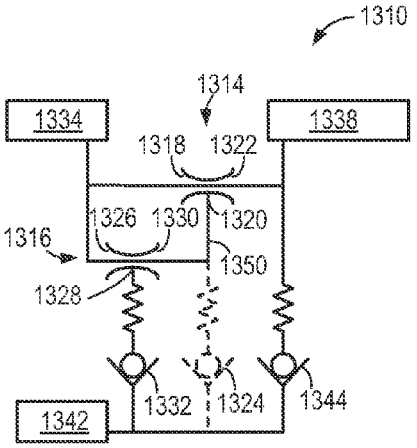
FIGS. 13-18 show example multi-aspirator intake systems.

Turning now to FIG. 13, shows a first example of an intake system 1310 having a plurality of aspirators. Multi-aspirator intake system 1310 includes at least first example aspirator 1314 and second example aspirator 1316 and may be included as part of an intake in an example vehicle to provide air for an example engine. First and second aspirators (1312 and 1314 respectively) may be example ejectors, injectors, eductors, venturi valves, jet pumps, or similar passive valve to generate vacuum (as discussed above, for example with respect to FIGS. 2 and 3. Further, first aspirator 1314 may be a different type of aspirator than second aspirator 1316, and may have smaller or larger physical dimensions than second aspirator 1316. In some examples, one of the first or second aspirator may be configured for high flow and the other of the two may be configured for low flow, thereby increasing an intake system's efficiency at generating vacuum over a wide pressure range. In this way, the aspirators 1314 and 1316 may be staged so that low pressure produced by one aspirator used by the other aspirator. By staging the aspirators in this way a deeper vacuum may be created than would otherwise be created with a single aspirator.

First aspirator 1314 has a first motive inlet 1318, first entraining inlet 1320, and first outlet 1322. The first motive inlet 1318 is in communication with an air pressure input 1334. One example of air pressure input 1334 is a high pressure outlet of a compressor (as described above, with respect to FIGS. 1, 4-7, and 10). Additional examples of air pressure input 1334 include an intake passage, for example adjacent a low pressure compressor inlet. First aspirator may include first check valve 1324 and is shown in dashed lines to indicate its optional nature. First check valve 1324 is positioned intermediate first entraining inlet 1320 and an example vacuum reservoir 1342. Furthermore, first check valve 1324 may limit communication from the first entraining inlet 1320 to vacuum reservoir 1342. Additionally, first outlet 1322 is in communication with a low pressure output 1338, examples of which include an intake manifold, and an intake passage (e.g., at a low pressure compressor input).

Second aspirator 1314 has a second motive inlet 1326, second entraining inlet 1328, second outlet 1330, and second check valve 1332. In some examples, second motive inlet 1326 is in communication with input 1334. In the present example, the second outlet 1330 is in communication with the first entraining inlet 1320. In the present example entraining passage 1350 couples the second outlet 1330 and the first entraining inlet 1320, and first check valve 1324 is coupled to the entraining passage 1350. In further examples, the second motive inlet 1326 is in communication with the first outlet 1320 and the second outlet 1330 may be in communication with low pressure output 1338 (e.g., as described below with respect to FIG. 18). Further, the second entraining inlet 1328 is in communication with vacuum reservoir 1342 via second check valve 1332. The second check valve 1332 limits communication from the second entraining inlet 1328 to the vacuum reservoir 1342.

Additionally, a third check valve 1344 is positioned intermediate the first outlet 1322 and the vacuum reservoir 1342. The third check valve 1344 limits flow from the vacuum reservoir 1342 to the first outlet 1322. In further examples of intake system 1310 include additional examples a solenoid valve is positioned intermediate the input 1334 and at least one of the first motive inlet 1318 and the second motive inlet 1326.

Figure 14:
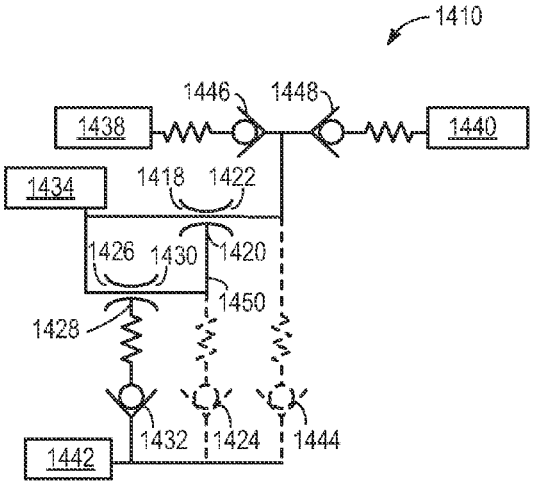

Turning now to FIG. 14, a second example of an intake system 1410 having a plurality of aspirators is shown. Multi-aspirator intake system 1410 includes at least first aspirator 1414 and second aspirator 1416. First aspirator 1414 may be a different type of aspirator than second aspirator 1416, and may have smaller or larger physical dimensions than second aspirator 1416. Further, first aspirator 1414 has a first motive inlet 1418, first entraining inlet 1420, and first outlet 1422. The first motive inlet 1418 is in communication with an example air pressure input 1434. Also, first aspirator may optionally include first check valve 1424 limiting communication from the first entraining inlet 1420 to vacuum reservoir 1442.

Additionally, first outlet 1422 is in communication with example intake manifold 1438 and intake passage 1440 (e.g., adjacent a low pressure compressor inlet). An outlet passage 1452 couples the first outlet 1422 to the intake manifold 1438, the outlet passage 1452 coupling the first outlet 1422 to the intake passage 1440 as well. A manifold check valve 1446 is positioned in the outlet passage 1452 intermediate the first outlet 1422 and the intake manifold 1438. The manifold check valve 1446 limits flow from the intake manifold 1438 to the first outlet 1422. An intake check valve 1448 is positioned in the outlet passage intermediate the first outlet 1422 and the intake passage 1440, the intake check valve limiting flow from the intake passage to the first outlet.

Second aspirator 1416 has a second motive inlet 1426, second entraining inlet 1428, second outlet 1430, and second check valve 1432. In some examples, second motive inlet 1426 is in communication with input 1434. In the present example, the second outlet 1430 is in communication with the first entraining inlet 1420 via an entraining passage 1450. First check valve 1424 is coupled to the entraining passage 1450. The second entraining inlet 1428 is in communication with vacuum reservoir 1442 via second check valve 1432 which limits communication from the second entraining inlet 1428 to the vacuum reservoir 1442. Additionally, a third check valve 1444 is optionally positioned intermediate the first outlet 1422 and the vacuum reservoir 1442. The third check valve 1444 limits flow from the vacuum reservoir 1442 to the first outlet 1422.

Figure 15:
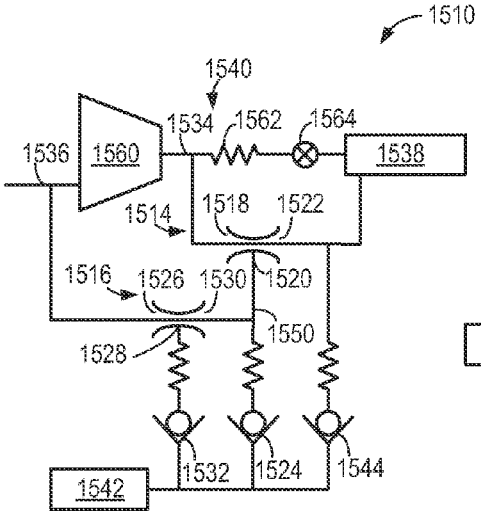

FIG. 15 shows a third example of an intake system 1510 having a plurality of aspirators. Multi-aspirator intake system 1510 includes at least first aspirator 1514 and second aspirator 1516. Furthermore, intake system 1510 includes intake passage 1540, which itself includes an example compressor 1560, intercooler 1562 and throttle 1564.

First aspirator 1514 may be a different type of aspirator than second aspirator 1516, and may have smaller or larger physical dimensions than second aspirator 1516. Further, first aspirator 1514 has a first motive inlet 1518, first entraining inlet 1520, first outlet 1522, and first check valve 1524. The first motive inlet 1518 is in communication with a high pressure compressor outlet 1534, which is a first air pressure input. First check valve 1524 limits communication from the first entraining inlet 1520 to vacuum reservoir 1542. Additionally, first outlet 1522 is in communication with example intake manifold 1538. Further examples of intake system 1510 include the first outlet 1522 in communication with intake passage 1540, e.g., adjacent a low pressure compressor inlet.

Second aspirator 1516 has a second motive inlet 1526, second entraining inlet 1528, second outlet 1530, and second check valve 1532. In the present example, motive inlet 1526 is in communication with intake passage 1548 adjacent low pressure compressor inlet 1536. Further, an entraining passage 1550 couples the second outlet 1530 and the first entraining inlet 1520, thereby placing them in fluid communication. First check valve 1524 is coupled to the entraining passage 1550. Further, the second entraining inlet 1528 is in communication with vacuum reservoir 1542 via second check valve 1532 which limits communication from the second entraining inlet 1528 to the vacuum reservoir 1542. Additionally, third check valve 1544 is positioned intermediate the first outlet 1522 and the vacuum reservoir 1542. The third check valve 1544 limits flow from the vacuum reservoir 1542 to the first outlet 1522.

Figure 16:
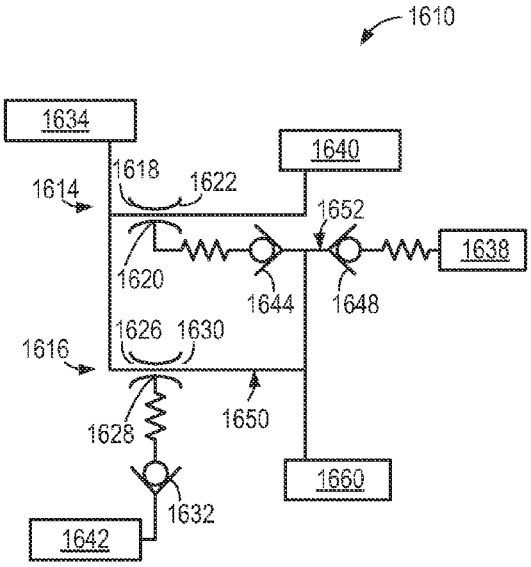

FIG. 16 shows a fourth example of an intake system 1610 having a plurality of aspirators. Multi-aspirator intake system 1610 includes at least first aspirator 1614 and second aspirator 1616. First aspirator 1614 may be a different type of aspirator than second aspirator 1616, and may have smaller or larger physical dimensions than second aspirator 1616. Further, first aspirator 1614 has a first motive inlet 1618, first entraining inlet 1620, and first outlet 1622. The first motive inlet 1618 is in communication with an example air pressure input 1634, which includes a compressor outlet pressure (COP) and/or a throttle inlet pressure (TIP). Also, first aspirator may optionally include first check valve 1624 limiting communication from the first entraining inlet 1620 to vacuum reservoir 1642.

Additionally, first outlet 1622 is in communication with example intake passage 1640 (e.g., adjacent a low pressure compressor inlet). Intake passage 1640 includes a barometric pressure (BP). In additional examples an intake check valve 1648 is positioned intermediate the first outlet 1622 and the intake passage 1640 (for example adjacent a low pressure inlet) the intake check valve limiting flow from the intake passage to the first outlet.

Second aspirator 1616 has a second motive inlet 1626, second entraining inlet 1628, second outlet 1630, and second check valve 1632. In some examples, second motive inlet 1626 is in communication with input 1634. In the present example, the second outlet 1630 is in communication with the first entraining inlet 1620 via an entraining passage 1650. The second entraining inlet 1628 is in communication with vacuum reservoir 1642 via second check valve 1632. The second check valve 1632 limits communication from the second entraining inlet 1628 to the vacuum reservoir 1642.

In the present example a first check valve 1624 is positioned in the entraining passage 1650 intermediate the second outlet 1630 and the first entraining inlet 1620. The first check valve 1624 limits flow from the first entraining inlet 1620 to the second outlet 1630. Further, an outlet passage 1652 is coupled the entraining passage 1650 intermediate the second outlet 1630 and the first check valve 1624. The outlet passage 1652 is also coupled to intake manifold 1638, the manifold 1638 including an intake manifold pressure (MAP) and a manifold check valve 1648 limits flow from the intake manifold 1638 to the entraining passage 1650.

In the present example, a fuel vapor purge system 1660 is coupled to the entraining passage 1650 intermediate the second outlet 1630 and the outlet passage 1652. Air passing through aspirator 1614 may draw air through entraining inlet 1620. In this way, aspirator 1614 is may be used to assist in fuel vapor purge. In further examples of intake system 1610, a PCV system is coupled to the entraining passage 1650 intermediate the second outlet 1630 and the outlet passage 1652.

Figure 17:
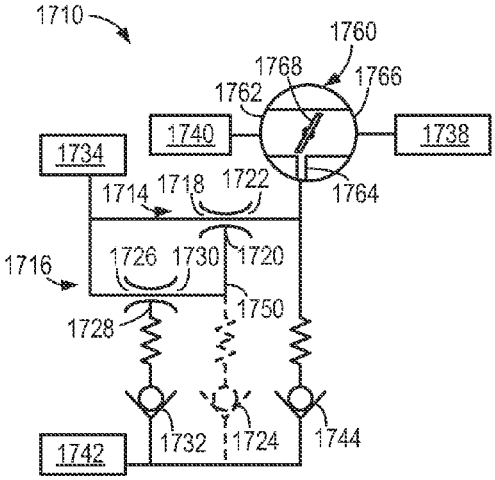

FIG. 17 shows a fifth example intake system 1710 having a plurality of aspirators. Multi-aspirator intake system 1710 includes at least first aspirator 1714 and second aspirator 1716. First aspirator 1714 may be a different type of aspirator than second aspirator 1716, and may have smaller or larger physical dimensions than second aspirator 1716. Further, first aspirator 1714 has a first motive inlet 1718, first entraining inlet 1720, and first outlet 1722. The first motive inlet 1718 is in communication with an example air pressure input 1734. Also, first aspirator may optionally include first check valve 1724 limiting communication from the first entraining inlet 1720 to vacuum reservoir 1742.

Additionally, first outlet 1722 is in communication with intake manifold 1738. Throttle 1760 is one example of a ported throttle, discussed above (with respect to FIG. 10). Throttle 1760 is positioned in intake passage 1740 and includes a first inlet 1762, a second inlet 1764, outlet 1766 and a plate 1768. The outlet 1722 of the aspirator 1714 is in communication with the second inlet 1764 of the throttle 1760. Throttle 1760 controls the pressure communicated to first outlet 1722. In one example, when throttle plate 1768 is rotated to a first angle, second inlet 1764 may be in communication with outlet 1766, while the throttle plate 1768 limits communication between the first inlet 1762 and the outlet 1766.

Second aspirator 1716 has a second motive inlet 1726, second entraining inlet 1728, second outlet 1730, and second check valve 1732. In the present example, the second outlet 1730 is in communication with the first entraining inlet 1720. In the present example entraining passage 1750 couples the second outlet 1730 and the first entraining inlet 1720, and first check valve 1724 is coupled to the entraining passage 1750. In further examples, the second motive inlet 1726 is in communication with the first outlet and the second outlet 1730 may be in communication with intake passage 1740, e.g., adjacent an example low pressure output. Further, the second entraining inlet 1728 is in communication with vacuum reservoir 1742 via second check valve 1732. The second check valve 1732 limits communication from the second entraining inlet 1728 to the vacuum reservoir 1742.

Additionally, a third check valve 1744 is positioned intermediate the first outlet 1722 and the vacuum reservoir 1742. The third check valve 1744 limits flow from the vacuum reservoir 1742 to the first outlet 1722.

Figure 18:
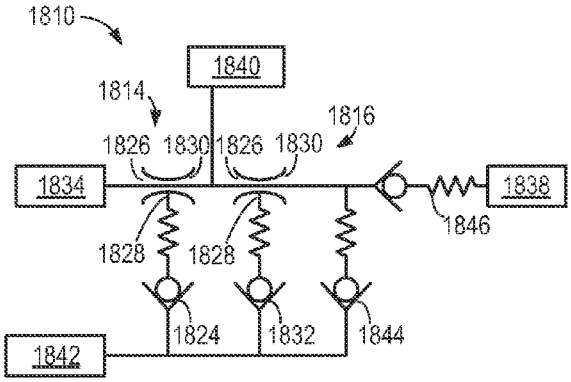

FIG. 18 shows a sixth example intake system 1810 having a plurality of aspirators. Multi-aspirator intake system 1810 includes at least first aspirator 1814 and second aspirator 1816. First aspirator 1814 may be a different type of aspirator than second aspirator 1816, and may have smaller or larger physical dimensions than second aspirator 1816. Further, first aspirator 1814 has a first motive inlet 1818, first entraining inlet 1820, and first outlet 1822. The first motive inlet 1818 is in communication with a high pressure compressor outlet 1834, which includes a COP and/or a TIP. Also, first aspirator includes first check valve 1824 limiting communication from the first entraining inlet 1820 to vacuum reservoir 1842.

Second aspirator 1816 has a second motive inlet 1826, second entraining inlet 1828, second outlet 1830, and second check valve 1832. In the present example, the first outlet 1822 is in communication with second motive inlet 1826. First outlet 1822 and second motive inlet 1826 are in communication with intake passage 1840 adjacent an example low pressure inlet of a compressor and includes a BP. Further, the second entraining inlet 1828 is in communication with vacuum reservoir 1842 via second check valve 1832. The second check valve 1832 limits communication from the second entraining inlet 1828 to the vacuum reservoir 1842. Second outlet 1830 is in communication with an intake manifold 1838 which includes a MAP. A manifold check valve 1846 is positioned intermediate the second outlet 1830 and intake manifold 1838 to limit flow from the intake manifold 1838 to the second outlet 1830. Additionally, a third check valve 1844 is intermediate the second outlet 1830 and vacuum reservoir 1842, the third check valve 1844 limiting flow from the second outlet 1830 to the vacuum reservoir 1842.

In this configuration, any flow between BP to MAP through an aspirator contributes to actuator vacuum. Any flow from COP or TIP to BP contributes to actuator vacuum. Either of these flow paths may be controlled by solenoid valves, passive valves, or ported throttles.

Figure 19:
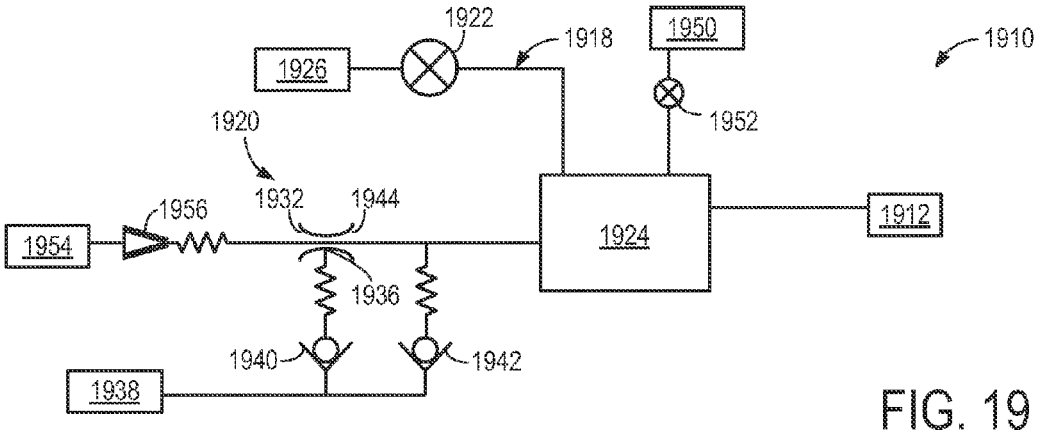
FIG. 19 shows a first example of an intake system including an aspirator integrated with additional engine systems.

Turning now to FIG. 19 a first example of an intake system 1910, including an aspirator 1920 integrated with additional engine systems is shown. Intake system 1910 includes an example manifold 1924 in communication with an example engine 1912. Intake system 1910 further includes example intake passage 1918 including throttle 1922. Intake air, such as from an example AIS or intercooler comes from input 1926. As discussed above, throttle 1922 may limit the air entering intake manifold 1924.

In the present example, fuel vapor purge system 1950 is in communication with manifold 1924 via fuel vapor purge valve 1952. Further, PCV system 1954 is in communication with manifold 1924. Intermediate PCV system 1954 and manifold 1924 is an example passive control valve 1956, valve 1956 limiting communication from manifold 1924 to PCV system 1954.

PCV system 1954 is also in communication with aspirator 1920. Aspirator 1920 includes example motive inlet 1932, entraining inlet 1936, outlet 1944, first check valve 1940 and auxiliary check valve 1942. Entraining inlet 1936 is in communication with an example vacuum reservoir 1938. Further, outlet 1944 is in communication with manifold 1924, as well as auxiliary check valve 1942.

In the present example, aspirator 1920 is positioned intermediate passive control valve 1956 and manifold 1924. Crankcase gases vented to manifold 1924 pass through aspirator motive inlet 1932, drawing air from entraining inlet 1936, and leaving via outlet 1944. In this way, air and crankcase gases may be used to generate vacuum during crankcase ventilation.

Figure 20:
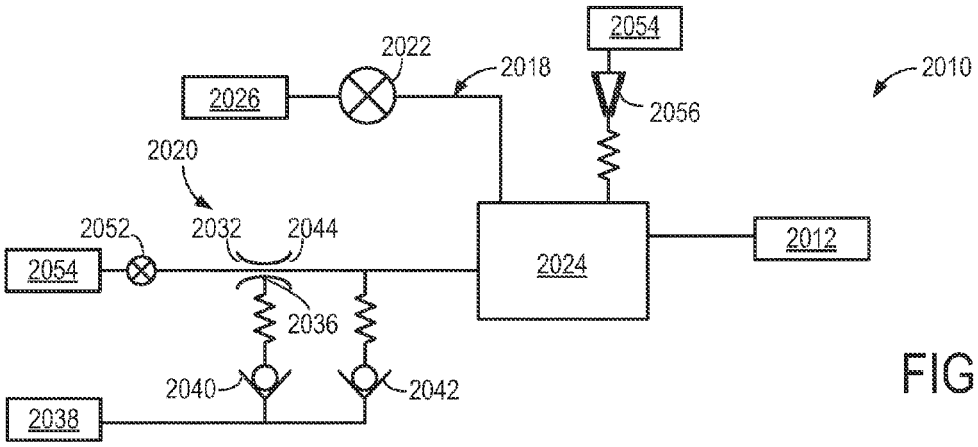
FIG. 20 shows a second example of an intake system including an aspirator integrated with additional engine systems.

FIG. 20 shows a second example intake system 2010 including an aspirator 2020 integrated with additional engine systems. Intake system 2010 includes an example manifold 2024 in communication with an example engine 2012. Intake system 2010 further includes example intake passage 2018 including throttle 2022. Intake air, such as from an example AIS or an example compressor and example intercooler comes from input 2026. As discussed above, throttle 2022 may limit the air entering intake manifold 2024.

In the present example, fuel vapor purge system 2050 is in communication with manifold 2024 via fuel vapor purge valve 2052. Further, PCV system 2054 is in communication with manifold 2024. Intermediate PCV system 2054 and manifold 2024 is an example passive control valve 2056, valve 2056 limiting communication from manifold 2024 to PCV system 2054.

Further, fuel vapor purge system 2050 is in communication with aspirator 2020. Aspirator 2020 includes example motive inlet 2032, entraining inlet 2036, outlet 2044, first check valve 2040 and auxiliary check valve 2042. Entraining inlet 2036 is in communication with an example vacuum reservoir 2038. Additionally, outlet 2044 is in communication with manifold 2024, as well as auxiliary check valve 2042.

In the present example, aspirator 2020 is positioned intermediate fuel vapor purge valve 2052 and manifold 2024. Purged fuel vapor, hydrocarbons and air vented to manifold 2024 pass through aspirator motive inlet 2032, drawing air from entraining inlet 2036, and leaving via outlet 2044. In this way, fuel vapor and hydrocarbon gases may be used to generate vacuum during fuel vapor purge. In further examples, including additional flowpaths, passageways and/or check valves, vacuum can be generated from both PCV flow and purge flow.

Finally, it will be understood that the articles, systems and methods described herein are exemplary in nature, and that these specific embodiments or examples are not to be considered in a limiting sense, because numerous variations are contemplated. Accordingly, the present disclosure includes all novel and non-obvious combinations and sub-combinations of the various systems and methods disclosed herein, as well as any and all equivalents thereof.

The invention claimed is:

1. An intake system comprising:

a throttle positioned downstream of a compressor, the throttle comprising a first inlet, a second inlet, and a plate, the plate located intermediate the first inlet and an outlet, the second inlet located intermediate the throttle plate and the first inlet, the throttle positioned in an intake passage;

an aspirator having a motive inlet in communication with the intake passage downstream of the compressor and upstream of the throttle, the aspirator having an outlet in communication with the second inlet of the throttle, the aspirator having an entraining inlet in communication with a vacuum reservoir via a first check valve, the first check valve limiting flow from the second inlet to the vacuum reservoir; and a controller including a physical memory with instructions for closing the throttle during idle airflow;

wherein the throttle is the only valve controlling flow from the intake passage through the aspirator to an intake manifold and flow from the intake passage to the intake manifold bypassing the aspirator.

2. The intake system of claim 1, further comprising a second check valve intermediate the vacuum reservoir and the intake manifold, the second check valve limiting flow from the intake manifold to the vacuum reservoir, where the throttle is positioned between the compressor and the an engine intake manifold, the system further comprising an intercooler coupled between the compressor and the throttle, and wherein the vacuum reservoir is a vacuum cavity behind a diaphragm in a brake booster.

3. An intake system having a plurality of aspirators, the system comprising:

a first aspirator having a first motive inlet, first entraining inlet, and first motive outlet, the first motive inlet in communication with an intake passage adjacent a high pressure outlet of a compressor; and a second aspirator having a second motive inlet, second entraining inlet, second motive outlet, and second check valve, where either the second motive outlet is in communication with the first entraining inlet or the second motive inlet is in communication with the first motive outlet, and the second entraining inlet is in communication with a vacuum reservoir via the second check valve, the second check valve limiting flow from the second entraining inlet to the vacuum reservoir;

a throttle positioned in the intake passage downstream of the high pressure outlet of the compressor, the throttle comprising a first throttle inlet, a second throttle inlet, and a plate, the plate located intermediate the first throttle inlet and the first motive outlet, the second throttle inlet located intermediate the throttle plate and the first throttle inlet, and the first motive outlet in communication with the second throttle inlet; and a controller including a physical memory with instructions for closing the throttle during idle airflow;

wherein the throttle is the only valve controlling flow from the intake passage through the first and second aspirators to an intake manifold and flow from the intake passage to the intake manifold bypassing the first and second aspirators.

4. The intake system of claim 3, further comprising a third check valve, the third check valve intermediate the first motive outlet and the vacuum reservoir, the third check valve limiting flow from the vacuum reservoir to the first motive outlet.

5. The intake system of claim 3, further comprising a first check valve, the first check valve intermediate the first entraining inlet and the vacuum reservoir, and the first check valve limiting flow from the first entraining inlet to the vacuum reservoir.

6. The intake system of claim 3, further comprising a first check valve and a third check valve, where an entraining passage couples the second motive outlet and the first entraining inlet, the first check valve intermediate the entraining passage and the vacuum reservoir, the first check valve limiting flow from the entraining passage to the vacuum reservoir, and the third check valve intermediate the first motive outlet and the vacuum reservoir, the third check valve limiting flow from the vacuum reservoir to the first motive outlet.

* * * * *